US011406884B2

(12) United States Patent
Nabeta

(10) Patent No.: US 11,406,884 B2
(45) Date of Patent: Aug. 9, 2022

(54) PRACTICE SWORD

(71) Applicant: Norio Nabeta, Kumamoto (JP)

(72) Inventor: Norio Nabeta, Kumamoto (JP)

( * ) Notice: Subject to any disclaimer, the term of this patent is extended or adjusted under 35 U.S.C. 154(b) by 0 days.

(21) Appl. No.: 17/266,319

(22) PCT Filed: May 29, 2019

(86) PCT No.: PCT/JP2019/021392

§ 371 (c)(1),
(2) Date: Feb. 5, 2021

(87) PCT Pub. No.: WO2020/035984

PCT Pub. Date: Feb. 20, 2020

(65) Prior Publication Data

US 2021/0308544 A1 Oct. 7, 2021

(30) Foreign Application Priority Data

Aug. 16, 2018 (JP) ..... JP2018-153266

(51) Int. Cl.
*A63B 69/00* (2006.01)

(52) U.S. Cl.
CPC .... *A63B 69/004* (2013.01); *A63B 2069/0044* (2013.01)

(58) Field of Classification Search
CPC ..... A63B 69/004; A63B 2069/0044; A63B 2071/0063; A63B 69/02; A63B 2069/0042; A63H 33/009
See application file for complete search history.

(56) References Cited

U.S. PATENT DOCUMENTS 5,295,926 A 3/1994 Tanabe
5,324,227 A * 6/1994 Yuh-Ching ..... A63H 33/009 446/473

(Continued)

FOREIGN PATENT DOCUMENTS

JP S48-67880 U 8/1973
JP S59-173 U 1/1984

(Continued)

OTHER PUBLICATIONS

PCT, International Search Report for the corresponding patent application No. PCT/JP2019/021392, dated Jul. 30, 2019, with English translation.

(Continued)

*Primary Examiner* — Nyca T Nguyen
(74) *Attorney, Agent, or Firm* — Lucas & Mercanti, LLP

(57) ABSTRACT

A practice sword for practicing martial arts includes a sword hilt body, a blade portion, and a guard portion that separates the sword hilt body and the blade portion. The practice sword is configured such that the sword hilt body and the blade portion have a vinyl chloride pipe as a common core. The blade portion is formed by surrounding the outer surface of the common core vinyl chloride pipe with styrene foam, arranging an elastic cushioning material on a distal surface thereof, and accommodating the styrene foam and the vinyl chloride pipe in a thin and long thick cloth bag. The sword hilt body is formed by abutting top and bottom rod-like pieces of wood against the top and bottom peripheral surfaces of the common core and winding a string around the surfaces of the top and bottom rod-like pieces of wood.

3 Claims, 2 Drawing Sheets

(56) References Cited

U.S. PATENT DOCUMENTS

| | | | | | |
|---|---|---|---|---|---|
| 5,630,998 | A * | 5/1997 | Parsons | A63H 33/009 | 434/11 |
| 6,010,435 | A * | 1/2000 | Tanabe | A63H 33/009 | 446/473 |
| 6,036,602 | A | 3/2000 | Abbott | | |
| 7,473,157 | B2 * | 1/2009 | Reinhardt | A63H 5/00 | 434/11 |
| 9,579,587 | B1 * | 2/2017 | Chen | A63H 33/009 | |
| 2001/0051542 | A1 * | 12/2001 | Dowdy | A63B 69/02 | 463/47.2 |
| 2004/0127292 | A1 * | 7/2004 | Chan | F41B 13/02 | 463/47.2 |
| 2010/0316983 | A1 * | 12/2010 | Johns, Jr. | A63B 69/02 | 434/247 |
| 2012/0214622 | A1 * | 8/2012 | Rockhill | A63B 69/3638 | 473/457 |
| 2017/0165548 | A1 * | 6/2017 | Phelan, Jr. | A63B 60/12 | |
| 2019/0184256 | A1 * | 6/2019 | Mainini | A63B 69/00 | |

FOREIGN PATENT DOCUMENTS

| | | | | |
|---|---|---|---|---|
| JP | S63-11068 | U | 1/1988 | |
| JP | H03-054673 | U | 5/1991 | |
| JP | H04-131267 | U | 12/1992 | |
| JP | H05-78265 | U | 10/1993 | |
| JP | 2012-075743 | A | 4/2012 | |
| JP | 2015-002849 | A | 1/2015 | |
| KR | 10-2004-0024830 | A | 3/2004 | |
| WO | WO-2005002685 | A1 * | 1/2005 | A63B 69/02 |

OTHER PUBLICATIONS

"Sports Chanbara is also protected by patents and trademarks," IP Positioning Strategy, retrieved Jan. 26, 2021, with machine English translation; https://ameblo.jp/kazuyan4649/entry-1203323176.html.

* cited by examiner

PRACTICE SWORD

CROSS REFERENCE TO RELATED APPLICATION

This Application is a 371 of PCT/JP2019/021392 filed on May 29, 2019 which, in turn, claimed the priority of Japanese Patent Application No. 2018-153266 filed on Aug. 16, 2018, both applications are incorporated herein by reference.

TECHNICAL FIELD

The present invention relates to a practice sword utilized for martial arts game such as ancient Japanese swordsmanship or sports or recreations.

BACKGROUND ART

Conventionally, it is conducted swordsmanship as sporting event or recreation. A practice sword utilized for in games or training of swordsmanship is emphasized in safety thereof, thus it is desired a practice sword through which swordsmanship can be learned without injuring body of athlete. As the practice sword for competitive use having dichotomic of safety and comprehension of swordsmanship, it is developed various practice swords (for example, Patent Literatures 1, 2).

In Patent Literature 1, a hollow tubular core member is formed in a length with same extent of a whole length of a sword and the core member of a portion corresponding to a blade portion of the sword is surrounded with cushioning material, further the this cushioning material and the core member are surrounded together by covering material. Thereby, constitution of the practice sword with safety is disclosed.

Furthermore, in Patent Literature 2, a plurality of tubular pipes are piled in parallel, thereby a sectional plane in a diameter direction of the pipes is formed into an ellipse shape and it is disclosed a constitution of the practice sword with safety which is constituted by a core member a top portion side of which is made as the blade portion and a base portion side of which is made as the grip portion, a blade portion shock absorbing member for absorbing shock which is wound around the blade portion and fixed thereto, a bag-like cover covering and fixing the blade portion shock absorbing member, a grip cushioning member fixed to the grip portion of the core member and a cap member to block the top portion of the core member.

CITATION LIST

Patent Literature

PL1: Japanese Patent application Laid-open No. 2012-075743

PL2: Japanese Patent Application Laid-open No. 2015-002849

SUMMARY OF INVENTION

Technical Problem

However, in the technology described in Patent Literature 1, although safety is secured by the cushioning member, the blade shape of practice sword is different from an actual blade shape, thus sense of use as the practice sword is different. Further, in the technology described in Patent Literature 2, since the blade shape is formed by piling the plural pipes in parallel, positional relations among the plural pipes are collapsed when the swords are contacted with each other during training or game, as a result, there is a fear that blade portion shape cannot be maintained.

Therefore, the present invention is done by taking the above problem into consideration and has an object to provide a practice sword through which similar shape with the Japanese sword is formed, sense of use is made close to the actual sword, there is no fear to get hurt when striking during training or game and there is no fear that the practice sword cannot be used due to breakage and the like.

Solution to Problem

According to one aspect of the present invention, it is provided a practice sword a practice sword for martial arts comprising:

a sword hilt body;

a blade portion; and a guard portion sectioning between the sword hilt body and the blade portion;

wherein a vinyl chloride pipe is provided over the sword hilt body and the blade portion as a common core member, wherein an outer peripheral surface of the vinyl chloride pipe of the common core member in the blade portion is enclosed by a styrene foam and an elastic cushioning member is provided to a top end portion of the blade portion, wherein the styrene foam and the vinyl chloride pipe are enclosed within a long thick cloth bag, and wherein in the sword hilt body top and bottom rod-like pieces of wood are contacted on semicircle arc peripheral surfaces of top and bottom sides among the peripheral surface of the common core member and a string is wound around surfaces of the top and bottom rod-like pieces of wood together with the common core member, the sword hilt body with a sectional plane of substantial elliptic is obtained.

Further, in selective one aspect of the present invention, it is provided the practice sword, wherein top and bottom mark lines are displayed toward a longitudinal direction on positions of the top and bottom semicircle arc of the peripheral surface of the blade portion.

Further, in a selective one aspect of the present invention, it is provided the practice sword, wherein a ratio of a diameter of the sword hilt body and a diameter of the blade portion is set to 1:2.

Advantageous Effects of Invention

According to the practice sword of the present invention, it is provided the practice sword comprising:

a sword hilt body;

a blade portion; and a guard portion sectioning between the sword hilt body and the blade portion;

wherein a vinyl chloride pipe is provided over the sword hilt body and the blade portion as a common core member, wherein an outer peripheral surface of the vinyl chloride pipe of the common core member in the blade portion is enclosed by a styrene foam and an elastic cushioning member is provided to a top end portion of the blade portion, wherein the styrene foam and the vinyl chloride pipe are enclosed within a long thick cloth bag, and wherein in the sword hilt body top and bottom rod-like pieces of wood are contacted on semicircle arc peripheral surface of top and bottom sides among the peripheral surface of the common core member and a string is wound around surfaces of the top and bottom rod-like pieces of wood together with the common core member, the sword hilt body with a sectional plane of substantial elliptic is obtained. Therefore, the practice sword can be used for a long time without deformation even if the blade portions contact with each other during training or game.

Further, the common core member constituted by vinyl chloride is enclosed by the styrene foam, thus the styrene foam functions as cushioning material to absorb shock at the time of strike and it is reduced as much as possible a fear to injure an opponent when striking the opponent.

Further, since the blade portion is constituted by enclosing the common core member through the styrene foam, the practice sword can be repaired only by exchanging the common core member when the common core member is unlikely snapped.

Further, since the blade portion is enclosed by the long thick cloth bag, it is reduced as much as possible a fear that broken pieces are scattered even if the common core member or the styrene foam is broken.

Further, since the sword hilt body is constituted by contacting the top and bottom rod-like pieces of wood on the top and bottom peripheral surfaces of the vinyl chloride which is the common core member and winding the string around the top and bottom rod-like pieces of wood, sectional plane of the sword hilt body becomes elliptic shape, thus such sectional plane becomes a shape to easily grasp by hands and it is reduced as much as possible a fear that the practice sword comes off from hands during training or game. Further, based on that the sword hilt body is made in elliptic shape, direction of the blade and the ridge of the blade portion can be recognized by grasping feeling through hands, thus it is not necessary to visually recognize what direction the blade direction faces.

Further, according to the practice sword of claim 2 in the present invention, the top and bottom mark lines are displayed toward a longitudinal direction on positions of the top and bottom semicircle arc of the peripheral surface of the blade portion. Therefore, it can be easily judged whether the blade contacts with the opponent during training or game or the portion other than the blade contacts.

Further, according to the practice sword of claim 3 in the present invention, a ratio of a diameter of the sword hilt body and a diameter of the blade portion is set to 1:2. Therefore, it can be obtained an effect that a width of the blade portion is wide and judgement in game can be easily conducted. Further, diameter of the sword hilt body becomes narrow, thus easy grasping can be realized. Further, by forming the center of gravity of the practice sword in the blade portion, similarly to the Japanese sword, sense of use can be made close to actual sword.

DESCRIPTION OF EMBODIMENTS

The summary of the present invention lies in that: it is provided the practice sword comprising:

a sword hilt body;

a blade portion; and a guard portion sectioning between the sword hilt body and the blade portion;

wherein a vinyl chloride pipe is provided over the sword hilt body and the blade portion as a common core member, wherein an outer peripheral surface of the vinyl chloride pipe of the common core member in the blade portion is enclosed by a styrene foam and an elastic cushioning member is provided to a top end portion of the blade portion, wherein the styrene foam and the vinyl chloride pipe are enclosed within a long thick cloth bag, and wherein in the sword hilt body top and bottom rod-like pieces of wood are contacted on semicircle arc peripheral surface of top and bottom sides among the peripheral surface of the common core member and a string is wound around surfaces of the top and bottom rod-like pieces of wood together with the common core member, the sword hilt body with a sectional plane of substantial elliptic is obtained. Furthermore, the top and bottom mark lines are displayed toward a longitudinal direction on positions of the top and bottom semicircle arc of the peripheral surface of the blade portion and a ratio of a diameter of the sword hilt body and a diameter of the blade portion is set to 1:2.

The embodiment of the present invention will be described in detail based on FIGS. 1 to 4.

Figure 1:
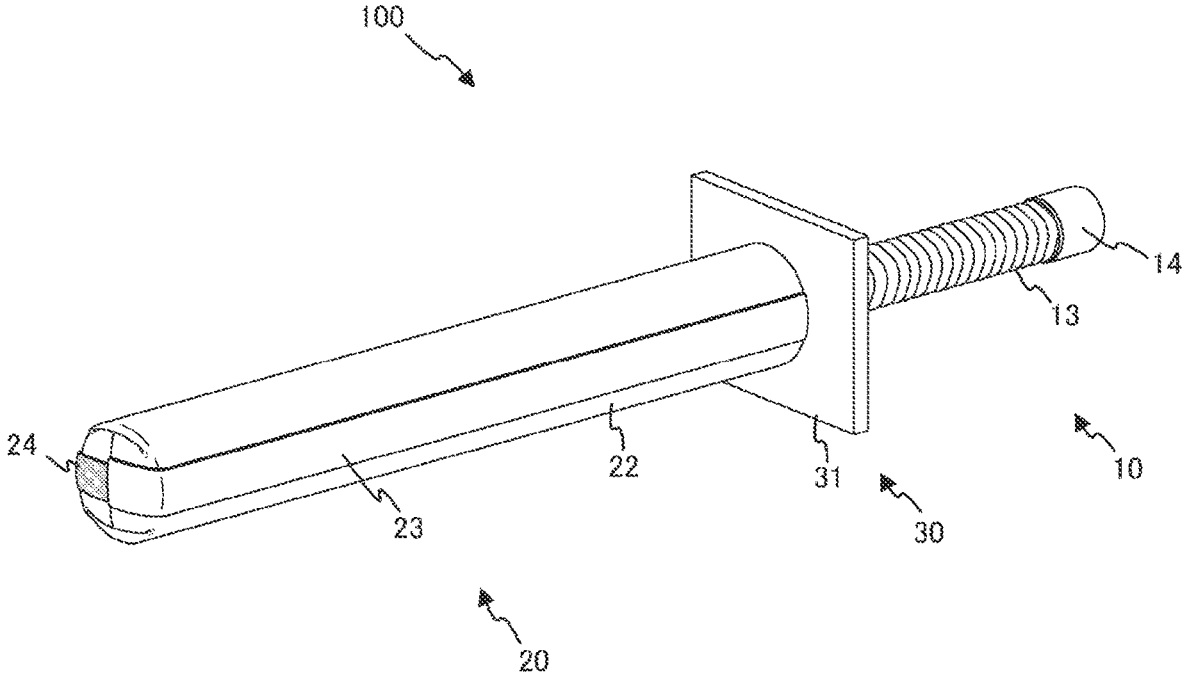
FIG. 1 is a perspective view indicating a lying state of a practice sword according to the embodiment of the present invention.

A practice sword 100, as shown in FIG. 1, is constituted from a sword hilt body 10, a blade portion 20 and a guard portion 30 that separates the sword hilt body 10 and the blade portion 20.

Figure 2:
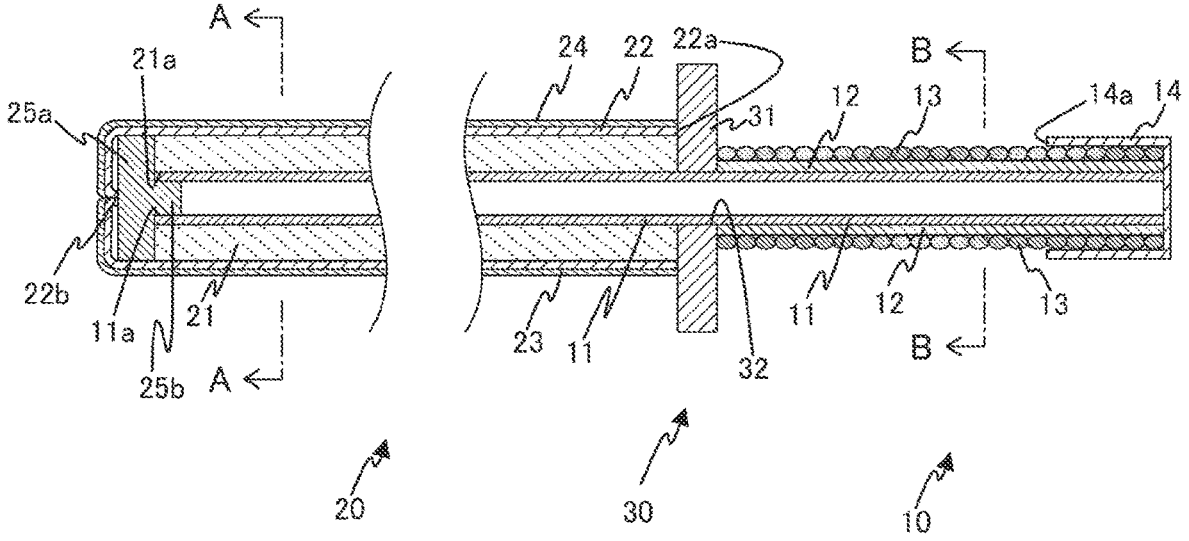
FIG. 2 is a sectional view by sectioning the practice sword in a longitudinal direction, the sectional view indicating an inner structure of the practice sword according to the embodiment of the present invention.

The sword hilt body 10, as shown in the sectional view of the practice sword 100 of FIG. 2, is constituted from a common core member 11 communicating with the blade portion 20, top and bottom rod-like pieces of wood 12, 12 arranged at mutual opposite positions along a longitudinal direction of a peripheral surface of the common core member 11 positioned in the sword hilt body 10, a string 13 enclosing the common core member 11 and the top and bottom rod-like pieces of wood 12, 12 and a pommel 14 provided at a terminal end portion of the common core member 11.

Figure 3:
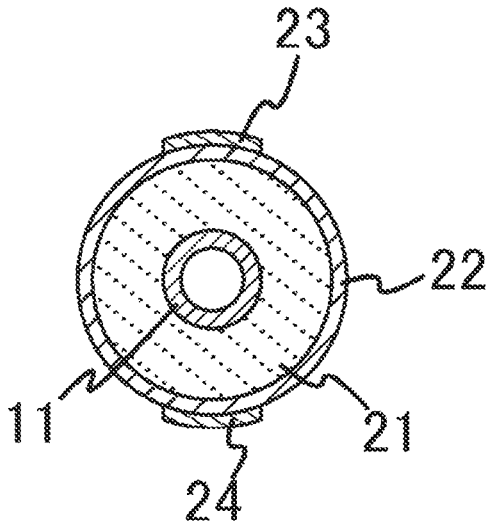
FIG. 3 is a A-A sectional view of FIG. 2 indicating the practice sword according to the embodiment of the present invention.
Figure 4:
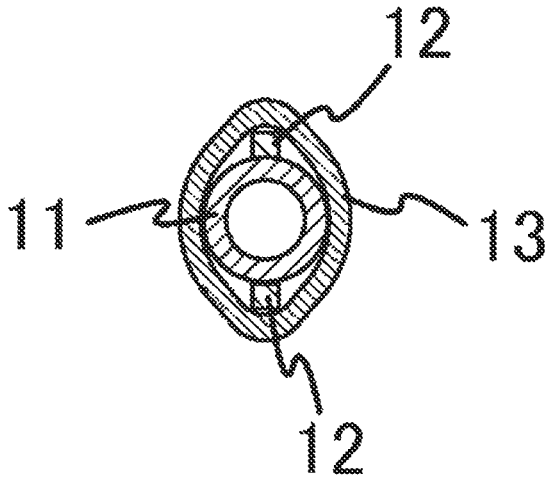
FIG. 4 is a B-B sectional view of FIG. 2 indicating the practice sword according to the embodiment of the present invention.

The common core member 11, as shown in FIG. 3, communicates to the blade portion 20 and is constituted into substantial cylindrical the center of which is made hollow. The common core member 11 is constituted of polyvinyl chloride and has deformation resistance through which the common core member 11 concludes to have low fear of deformation even if strike occurs during training or game. Here, the common core member 11 is not limited to polyvinyl chloride pipe and any material can be utilized if the common core material is constituted of material with low elastic force or low flexibility through which low fear of deformation or breakage is realized at the time of strike by the members of same material. For example, the common core member may be formed of glass fiber.

Further, at the opposite positions along the longitudinal direction of peripheral surface in the common core member 11, the top and bottom rod-like pieces of wood 12, 12 are adhered. The top and bottom rod-like pieces of wood 12, 12 are square bars with square sectional planes and are extended from the terminal end portion of the sword hilt body 10 to the lower plane portion of a hand guard 31 of the guard portion 30. Further, circumference surfaces of the common core member 11 and the top and bottom rod-like pieces of wood 12, 12 are surrounded by the string 13. Further, at the terminal end portion of the sword hilt body 10, that is, the terminal end portion of the common core member 11, the pommel 14 is provided.

The pommel 14 has a sectional plane of substantial elliptic shape and an inner peripheral surface thereof is constituted so as to have a minor axis with a length substantially equal with a diameter of the common core member 11 and a major axis with a length substantially equal with a length that the diameter of the common core member 11, two top and bottom rod-like pieces of wood 12, 12 adhered to the peripheral surface of the common core member 11 and two diameters of the string 13 are mutually added. In an opening portion 14*a* of this pommel 14, the common core member 11, the top and bottom rod-like pieces of wood 12, 12 and the string 13 are inserted, thereby the sword hilt body 10 is formed.

As mentioned in the above, based on that the sword hilt body 10 is constituted into a vertically long sectional plane of elliptic shape, grasping form capable of easily grasping can be realized, thereby the practice sword 100 is constituted in to a form capable of easily swinging.

The blade portion 20, as shown in FIG. 2, is constituted from the substantially tubular common core member 11, a styrene foam 21 enclosing the common core member 11 arranged on the blade portion 20, a long thick cloth bag 22 enclosing the common core member 11 and styrene foam 21 together and mark line 23, 24 formed in a longitudinal direction of peripheral surface of the long thick cloth bag 22.

The styrene foam 21 is substantial cylindrical and an inner diameter thereof is constituted so as to become substantially equal with an outer diameter of the common core member 11. Form of the blade portion 20 is constituted by inserting the common core member 11 from the opening portion 21*a* side of the styrene foam 21. Here, the styrene foam 21 is provided to mitigate shock occurring at the time of strike and material thereof may be constituted from material made from foamed resin with suitable strength.

Further, in a top portion of the common core member 11, that is, in a top portion of the blade portion 20, an elastic inserting protrusion (elastic cushioning member) 25*b* is formed in a center of a column 25*a* and this elastic inserting protrusion 25*b* is inserted in an opening portion 11*a* of the pipe-like common core member 11, thereby the top portion of the common core member 11 is formed.

The whole peripheral surface of blade portion 20 is constituted so as to be enclosed by the long thick cloth bag 22. The long thick cloth bag 22 is formed from non-woven fabric as raw material. Further, an opening portion 22*a* is formed at one end portion thereof and a blocking portion 22*b* is formed at the other end portion by sewing the non-woven fabrics together in the substantial center portion when seen according to flat surface. Thereby, the blade portion 20 is formed in a long narrow state cloth bag.

On the blocking portion 22*b*, there are integrally sewed one end portions of the long narrow state mark lines 23, 24 to show ridge and blade of the blade portion 20. The other end portions of the long narrow state mark lines 23, 24 to shown ridge and blade of the blade portion 20 are arranged in a long thin belt along the outer side surface of the long thick cloth bag 22 from the top portion to the base portion of the blade portion 20. The mark lines 23 and 24 show blade and ridge of the blade portion 20. Further, the mark lines 23, 24 are respectively colored. The mark line 23 showing blade of the blade portion 20 is colored in red and the mark line 24 showing ridge of the blade portion 20 is colored in white. As mentioned, since the mark lines 23, 24 are colored in different colors, it can be easily judged whether the blade portion 20 is contacted by the blade side or by the ridge side during training or game. Here, although colors of the mark lines 23, 24 are shown by red color and white color in the present embodiment, colors of the mark lines 23, 24 are not especially limited to these colors. It may be good if the blade and the ridge are colored so as to be able to easily judge the blade and the ridge such as color combination of blue color and yellow color.

Further, between the base portion of the blade portion 20 and the base portion of the sword hilt body 10, the guard portion 30 is provided. The guard portion 30 is constituted from the hand guard 31 with substantial square shape when seen from front side. Especially, since the hand guard 31 is formed in the square shape, it is constituted so that the practice sword according to the present invention does not roll when the practice sword is horizontally put on the flat plane. Further, in the substantial center portion of the hand guard 31, it is formed an insertion hole 32 to insert the common core member 11.

Further, an upper surface of the hand guard 31 is contacted with the terminal end portion of styrene foam 21 of the blade portion 20 and a lower surface of the hand guard 31 is contacted with the top and bottom rod-like pieces of wood 12, 12 and the string 13 of the sword hilt body 10. Thereby, the hand guard 31 is fixed.

Here, the hand guard 31 has a role to guard the hand grasping the sword hilt body 10 when carved by the opponent during training or game or function so that the grasping hand does not slide forward the blade side when striking.

Further the hand guard 31 carries weight balance of the sword hilt body 10 and the blade portion 20 when the practice sword 100 is swung downward and the hand guard 31 is positioned at a position that the blade portion 20 is easily swung downward in cooperation with weight of the sword similarly to the actual sword. In particular, in the present embodiment, a ratio of the diameter of the sword hilt body 10 and the diameter of the blade portion 20, both constituting the practice sword 100, is made 1:2, thereby center of gravity of the practice sword 100 is positioned to the blade portion 20 side. Further, since the hand guard 31 is provided between the sword hilt body 10 and the blade portion 20, weight balance through which the practice sword 100 is easily swung downward is realized.

It will be described a procedure to produce the practice sword constituted in the above.

First, circumference of a portion corresponding to the blade portion 20 of the common core member 11 is enclosed by the styrene foam 21.

Next, the elastic inserting protrusion 25*b* formed from elastic material at the center of the column 25*a* is inserted within the opening portion 11*a* of the common core material 11. Thereafter, the long thick cloth bag 22 is covered from the top portion of the column 25*a* toward the terminal end portion of the styrene foam 21, thereby the blade portion 20 is formed.

Next, the insertion hole 32 of the hand guard 31 is inserted to the common core member 11 from the base portion of the common core member 11 positioned in the sword hilt body 10 and the hand guard 31 is moved to a position where the hand guard 31 contacts with the lower portion of the blade portion 20, that is, the lower end portion of the styrene foam 21. Thereby, the guard portion 30 is formed.

Next, the top and bottom rod-like pieces of wood 12, 12 are fixed by double sided tape at the opposite positions on the peripheral surface of the common core member 11, the common core member 11 being positioned in the sword hilt body 10, in the longitudinal direction. Next, the string 13 is wound around from the base portion of the common core member 11 and the top and bottom rod-like pieces of wool 12, 12, that is, from the lower end portion of the guard portion 30 to the terminal end portion of the common core member 11. Here, a start portion and an end portion of the wound string 13 are wound and fixed to the common core member 11 and the top and bottom rod-like pieces of wood 12, 12 by a vinyl tape.

Next, the opening portion 14*a* of the pommel 14 is inserted from the terminal end portion of the common core member 11, thereby it is formed the sword hilt body 10 covering the common core member 11, the top and bottom rod-like pieces of wood 12, 12 and the string 13.

According to the practice sword 100 formed by the above procedure, it can be provided the practice sword 100 through which form and weight similar to the Japanese sword can be obtained, thereby sense of use can be made close to actual sword, there is no fear to get hurt at the time of strike during training or game, further there is no fear unable to use due to breakage and the like.

Here, the present invention is not limited to the above mentioned embodiment and it is included within the present invention constitution in which each constitution disclosed in the above embodiment is mutually substituted and combination thereof is changed and publicly known invention, further constitution in which each constitution disclosed in the above embodiment is mutually substituted and combination thereof is changed. Further, technical scope of the present invention is not limited to the above mentioned embodiment and is extended to contents described in claims and equivalents thereof.

REFERENCE SIGNS

10 sword hilt body
11 common core member
11*a* opening portion
12 top and bottom rod-like piece of wood
13 string
14 pommel
14*a* opening portion
20 blade portion
21 styrene foam
21*a* opening portion
22 long thick cloth bag
22*a* opening portion
22*b* blocking portion
23, 24 mark line
25*a* column
25*b* insertion protrusion
30 guard portion
31 hand guard
32 insertion hole
100 practice sword

The invention claimed is:

1. A practice sword for martial arts comprising:
a sword hilt body;
a blade portion; and
a guard portion sectioning between the sword hilt body and the blade portion;
wherein a vinyl chloride pipe is provided to the sword hilt body and the blade portion as a common core member,
wherein an outer peripheral surface of the vinyl chloride pipe of the common core member in the blade portion is enclosed by a styrene foam and an elastic cushioning member is provided to a top end portion of the blade portion,
wherein the styrene foam and the vinyl chloride pipe are enclosed within a long thick cloth bag, and
wherein the sword hilt body comprises top and bottom rod pieces of wood in contact with a semicircle arc peripheral surface of top and bottom sides of a peripheral surface of the common core member and a string is wound around surfaces of the top and bottom rod pieces of wood on the common core member, and wherein a sectional plane of the sword hilt body is substantially elliptical.

2. The practice sword according to claim 1, wherein top and bottom mark lines are displayed along a longitudinal direction of the blade portion and positioned on top and bottom sides of a peripheral surface of the blade portion.

3. The practice sword according to claim 1, wherein a ratio of a diameter of the sword hilt body and a diameter of the blade portion is set to 1:2.

* * * * *